US008331845B2

(12) United States Patent
Kon et al.

(10) Patent No.: US 8,331,845 B2
(45) Date of Patent: Dec. 11, 2012

(54) IMAGE FORMING APPARATUS WITH MOVABLE RECORDING MEDIUM GUIDE MEMBERS

(75) Inventors: Hiroshi Kon, Kashiwazaki (JP); Kaoru Watanabe, Kashiwazaki (JP); Hideki Sato, Kashiwazaki (JP); Akio Miyazaki, Kashiwazaki (JP); Koichi Tanaka, Kashiwazaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 461 days.

(21) Appl. No.: 12/388,666

(22) Filed: Feb. 19, 2009

(65) Prior Publication Data

US 2009/0238618 A1 Sep. 24, 2009

(30) Foreign Application Priority Data

Mar. 21, 2008 (JP) ..... 2008-073536
Sep. 24, 2008 (JP) ..... 2008-243697

(51) Int. Cl.
*G03G 15/00* (2006.01)

(52) U.S. Cl. ..... 399/401; 399/397; 399/405

(58) Field of Classification Search ..... 399/401, 399/397, 405; 271/65, 303, 186, 291, 301
See application file for complete search history.

(56) References Cited

U.S. PATENT DOCUMENTS 5,237,381 A * 8/1993 Hamada ..... 399/406
2005/0232672 A1* 10/2005 Nakamura et al. ..... 399/405
2006/0193666 A1* 8/2006 Tomatsu ..... 399/401
2006/0239734 A1* 10/2006 Ohtsuki ..... 399/401
2007/0242968 A1* 10/2007 Chiba ..... 399/66

FOREIGN PATENT DOCUMENTS

| | | | |
|---|---|---|---|
| JP | 63-165232 A | | 7/1988 |
| JP | 2-123066 A | | 5/1990 |
| JP | 6-16279 A | | 1/1994 |
| JP | 11-125983 A | | 5/1999 |
| JP | 2003-316087 A | | 11/2003 |
| JP | 2006-193328 | * | 7/2006 |
| JP | 2007-70004 A | | 3/2007 |
| JP | 2007-197105 A | | 8/2007 |
| JP | 2007-297141 A | | 11/2007 |

* cited by examiner

*Primary Examiner* — Judy Nguyen
*Assistant Examiner* — Blake A Tankersley
(74) *Attorney, Agent, or Firm* — Morgan, Lewis & Bockius LLP

(57) ABSTRACT

An image forming apparatus includes: an image forming apparatus main body; a cover provided openably/closably with respect to the image forming apparatus main body; a conveyance passage, formed in the image forming apparatus main body, on which a recording medium is conveyed; a detection device that detects movement of the recording medium conveyed on the conveyance passage; a first recording medium guide member provided oppositely to the moving member and fixed when the cover is closed; and a second recording medium guide member, provided on a downstream side of and following the first recording medium guide member in a recording medium conveyance direction, that movably guides the conveyed recording medium.

10 Claims, 8 Drawing Sheets

IMAGE FORMING APPARATUS WITH MOVABLE RECORDING MEDIUM GUIDE MEMBERS

CROSS-REFERENCE TO RELATED APPLICATION

This application is based on and claims priority under 35 USC 119 from Japanese Patent Application Nos. 2008-073536 filed Mar. 21, 2008 and 2008-243697 filed Sep. 24, 2008.

BACKGROUND

1. Technical Field

The present invention relates to an image forming apparatus.

2. Related Art

Conventionally known is an image forming apparatus capable of double-sided recording, having a fixing device to fix toner on a recording medium to the recording medium with pressure and heat. In the image forming apparatus, an image is formed on a first surface of the recording medium by the fixing device, then the recording medium is reversed, and is passed through the fixing device again, thereby an image is formed on a second surface of the recording medium.

SUMMARY

According to an aspect of the invention, there is provided an image forming apparatus including: an image forming apparatus main body; a cover provided openably/closably with respect to the image forming apparatus main body; a conveyance passage, formed in the image forming apparatus main body, on which a recording medium is conveyed; a detection device that detects movement of the recording medium conveyed on the conveyance passage; a first recording medium guide member provided oppositely to the moving member and fixed when the cover is closed; and a second recording medium guide member, provided on a downstream side of and following the first recording medium guide member in a recording medium conveyance direction, that movably guides the conveyed recording medium.

BRIEF DESCRIPTION OF THE DRAWINGS

Exemplary embodiments of the present invention will be described in detail based on the following figures, wherein.

DETAILED DESCRIPTION

Next, exemplary embodiments of the present invention will be described based on the drawings.

Figure 1:
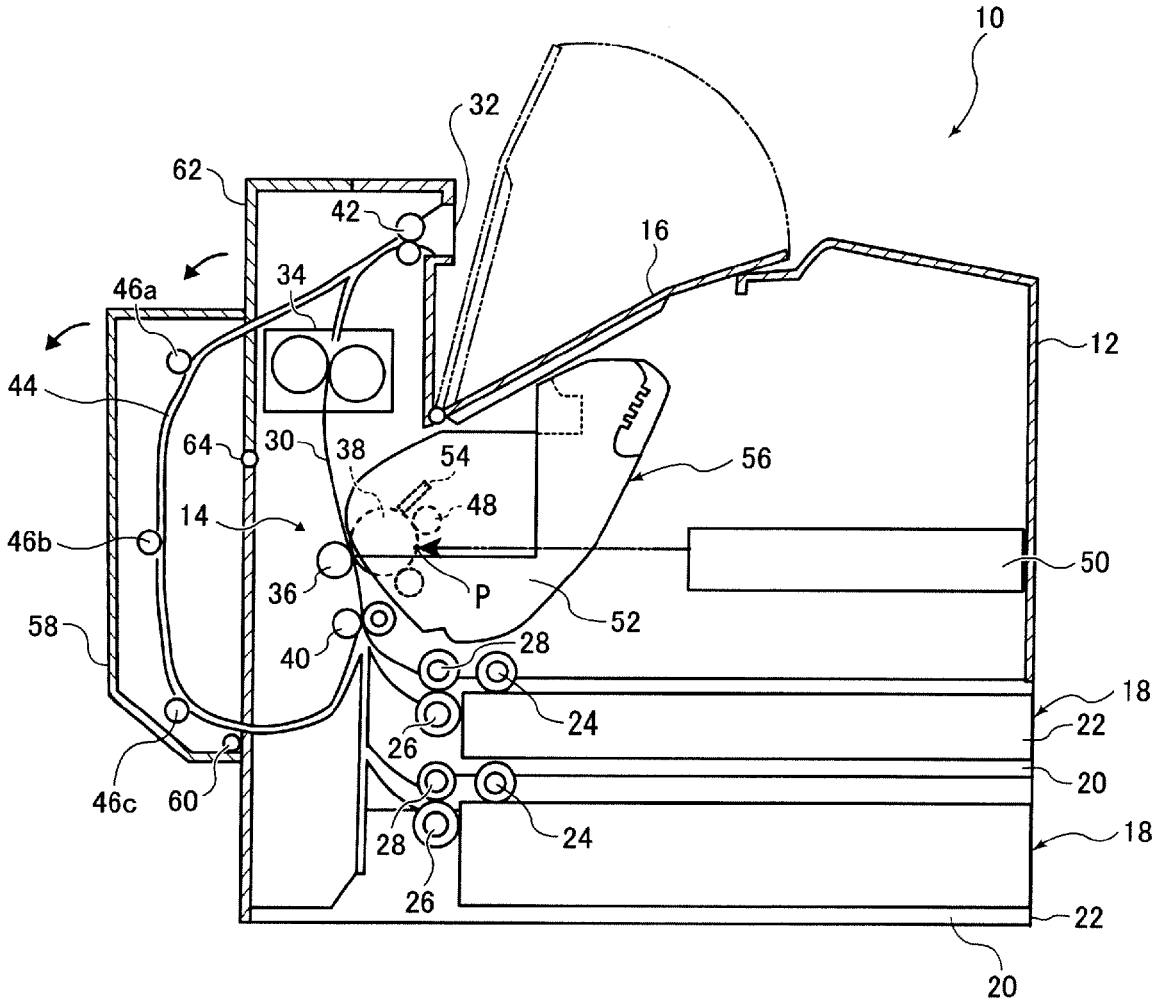
FIG. 1 is a cross-sectional view showing an image forming apparatus according to a first exemplary embodiment of the present invention.

FIG. 1 schematically shows the structure of an image forming apparatus 10 according to a first exemplary embodiment of the present invention. The image forming apparatus 10 has an image forming apparatus main body 12. An image forming unit 14 is installed in the image forming apparatus main body 12, and a discharge part 16 to be described later is provided in an upper part of the image forming apparatus main body 12, further, e.g. two-stage paper supply units 18 are provided in a lower part of the image forming apparatus main body 12. Further, plural optional paper supply units can be arranged below the image forming apparatus main body 12.

The paper supply units 18 respectively have a paper-supply unit main body 20 and a paper supply cassette 22 containing recording media. A pickup roller 24 is provided above a position in the vicinity of a rear end of the paper cassette 22, and a retard roller 26 and a feed roller 28 are provided in the rear of the pickup roller 24.

A conveyance passage 30 is a recording medium passage from the feed roller 28 to a discharge outlet 32. The conveyance passage 30 has an approximately vertical portion formed from the lowest-end paper supply unit 18 to a fixing device 34 to be described later in the vicinity of a rear side of the image forming apparatus main body 12 (left side surface in FIG. 1). A transfer device 36 and an image holder 38 to be described later are provided on the conveyance passage 30 on the upstream side of the fixing device 34. Further, a registration roller 40 is provided on the upstream side of the transfer device 36 and the image holder 38. Further, a discharge roller 42 is provided on the conveyance passage 30 in the vicinity of the discharge outlet 32.

Accordingly, a recording medium sent with the pickup roller 24 from the paper supply cassette 22 of the paper supply unit 18 is retarded with cooperation between the retard roller 26 and the feed roller 28 and only a top recording medium is guided to the conveyance passage 30, temporarily stopped with the registration roller 40, passed between the transfer device 36 and the image holder 38 to be described later at predetermined timing and a developer image is transferred to the recording medium. The transferred developer image is fixed to the recording medium by the fixing device 34, and the recording medium is discharged with the discharge roller 42 from the discharge outlet 32 to the discharge part 16.

Note that in the case of double-sided printing, the recording medium is returned to a reverse passage branched from the conveyance passage 30. That is, the conveyance passage 30 is forked in front of the discharge roller 42, and a reverse passage (first branch passage) 44 is formed from the forked portion to the registration roller 40. The reverse passage 44 is provided with conveyance rollers 46*a* to 46*c*. For double-sided printing, the discharge roller 42 is reverse-rotated at timing where the rear end of the recording medium arrives at the discharge roller 42. Then the recording medium is guided to the reverse passage 44, passed through the registration roller 40, the transfer device 36 and the image holder 38, and the fixing device 34, and discharged from the discharge outlet 32 to the discharge part 16.

The image forming unit 14, which is e.g. an electrophotographic unit, has the image holder 38 having a photoreceptor, a charging device 48 having e.g. a charging roller to uniformly charge the image holder 38, an optical writing device 50 to optically write a latent image on the image holder 38 charged by the charging device 48, a developing device 52 to visualize the latent image on the image holder 38 formed by the optical writing device 50 with a developer, the transfer device 36 having e.g. a transfer roller to transfer the developer image formed by the developing device 52 to a recording medium, a cleaning device 54 having e.g. a blade to remove the developer remaining on the image holder 38, and the fixing device 34 to fix the developer image on the recording medium transferred by the transfer device 36 to the recording medium. The optical writing device 50, having e.g. a scanning laser exposure device, is provided in the vicinity and right in front of the image forming apparatus main body 12 in parallel with the above-described paper supply unit 18. The optical writing device 50 exposes the image holder 38 while crossing inside the developing device 52. The exposure position in the image holder 38 is a latent image writing position P.

Note that in the present exemplary embodiment, a scanning laser exposure device is used as the optical writing device 50; however, an LED, a surface light emission type laser and the like may be used as other exemplary embodiments.

In a process cartridge 56, in which the image holder 38, the charging device 48, the developing device 52 and the cleaning device 54 are integrated, these devices are exchanged as an integrated combination. The process cartridge 56 is removed from the image forming apparatus main body 12 by opening the discharge part 16.

A double-sided recording unit 58 is attached to the above-described image forming apparatus main body 12. The double-sided recording unit 58 includes a part of the above-described reverse passage 44 and the conveyance rollers 46*a* to 46*c*. When a latch (not shown) provided in an upper part of the double-sided recording unit 58 is removed, the double-sided recording unit 58 can be rotated in a counterclockwise direction about a first shaft 60 provided in a lower part of the double-sided recording unit 58, as indicated with an arrow. Further, the periphery of the fixing device 34 is covered with a cover 62. When a latch (not shown) is removed, the cover 62 can be rotated in a counterclockwise direction about a second shaft 64 provided in a lower part of the cover 62, as indicated with an arrow.

Next, the fixing device 34 and peripheral elements of the fixing device 34 will be described in detail using FIG. 2 and FIG. 3.

Figure 2:
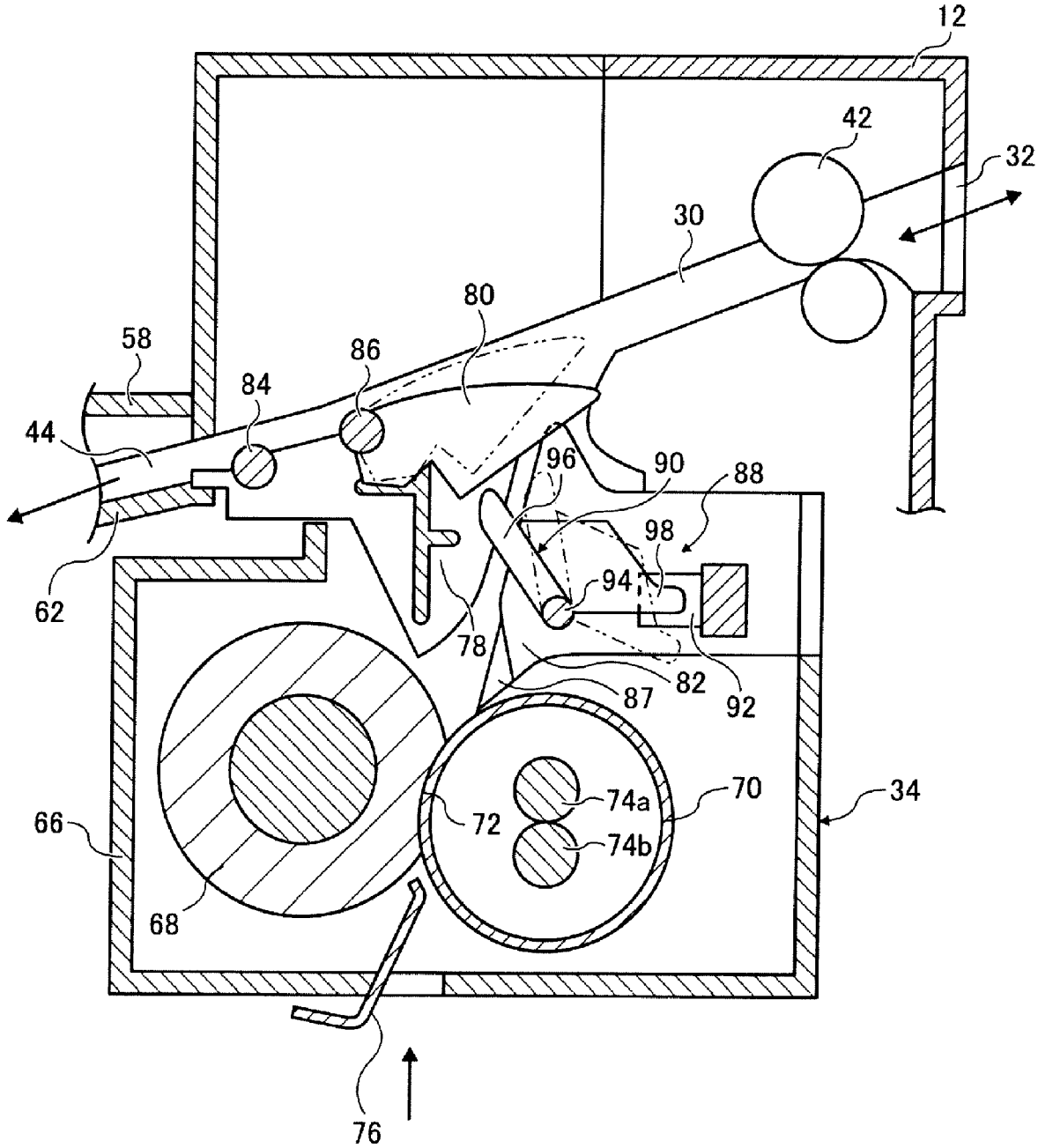
FIG. 2 is a cross-sectional view showing a double-sided recording unit, a fixing device 34 with its cover closed and peripheral elements of the fixing device 34 in the first exemplary embodiment of the present invention.
Figure 3:
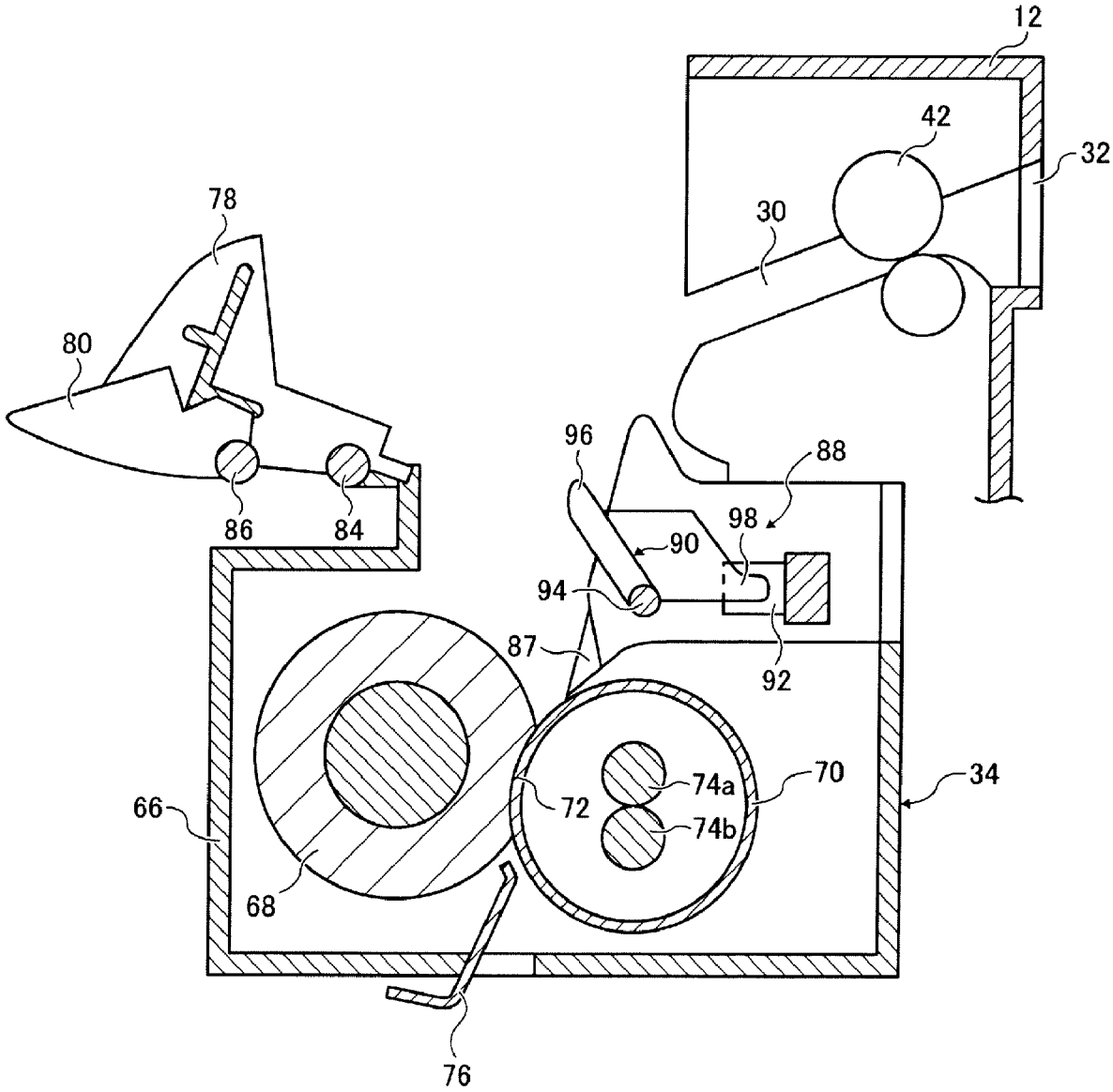
FIG. 3 is a cross-sectional view showing the double-sided recording unit, the fixing device 34 with its cover opened, in which a first recording medium guide member and a second recording medium guide member are opened, and the peripheral elements of the fixing device 34 in the first exemplary embodiment of the present invention.

FIG. 2 is a cross-sectional view showing the double-sided recording unit 58, the fixing device 34 with the cover 62 closed and the peripheral elements of the fixing device 34. FIG. 3 is a cross-sectional view showing the double-sided recording unit 58, the fixing device 34 with the cover 62 opened, in which a first recording medium guide member and a second recording medium guide member to be described later are opened, and the peripheral elements of the fixing device 34.

The fixing device 34 has a fixing device main body 66 formed with resin or the like. The fixing device main body 66 is fixed to the image forming apparatus main body 12. Further, the fixing device main body 66 include, as a fixing member, a pressure roller 68 and a heating roller 70. The periphery of the pressure roller 68 is an elastic body, and the pressure roller 68 and the heating roller 70 are in contact with each other via a press contact part 72. Further, the heating roller 70 includes e.g. two lamps 74*a* and 74*b*. When the lamps 74*a* and 74*b* are turned on, the heating roller 70 is heated.

An entrance-side guide part 76 is provided on the upstream side of the press contact part 72 in a recording medium conveyance direction (lower side in the gravitational direction). The entrance-side guide part 76 guides a recording medium toward the press contact part 72. Further, a first recording medium guide member 78, a second recording medium guide member 80 and a third recording medium guide member 82 are provided on the downstream side of the press contact part 72 in the recording medium conveyance direction (upper side in the gravitational direction). The first recording medium guide member 78 is supported via a first support shaft 84 rotatably with respect to the fixing device main body 66. As shown in FIG. 2, when the cover 62 is closed, the first recording medium guide member 78 abuts against the fixing device main body 66 in the clockwise direction, while abuts against the cover 62 in the counterclockwise direction, and is fixed to the fixing device main body 66. When the cover 62 is opened, the engagement between the cover 62 and the first recording medium guide member 78 is released, and as shown in FIG. 3, the cover 62 becomes rotatable in the counterclockwise direction about the first support shaft 84. The second recording medium guide member 80 is provided following the first recording medium guide member 78 on the downstream side of the first recording medium guide member 78 in the recording medium conveyance direction. The second recording medium guide member 80 is supported via a second support shaft 86 rotatably with respect to the first recording medium guide member 78. Note that the second recording medium guide member 80 abuts against the first recording medium guide member 78, thereby regulated such that the rotatable angle of the second recording medium guide member 80 is equal to or less than e.g. 90°. The second recording medium guide member 80 is rotatable within a range between a position indicated with a solid line and a position indicated with an alternate long and two short dashes line in FIG. 2. The second recording medium guide member 80 is rotated from the position indicated with the solid line to the position indicated with the alternate long and two short dashes line by the elasticity of a passing recording medium, and together with the first recording medium guide member 78 and the third recording medium guide member 82, guides the recording medium passing through the conveyance passage 30. On the other hand, the second recording medium guide member 80 is returned to the position indicated with the solid line by the gravity or a pressing force by a pressing member such as a spring, and guides a recording medium conveyed by reverse rotation of the discharge roller 42 to the reverse passage 44. The third recording medium guide member 82, integrally formed with the fixing device main body 66, is provided oppositely to the first recording medium guide member 78 and the second recording medium guide member 80.

Note that a separation claw 87 is provided in a lower part of the third recording medium guide member 82, and a recording medium which is wrapped around the heating roller 70 is separated with the separation claw 87.

The detection device 88 detects a passing recording medium. The detection device 88 has a moving member 90 rotate-moved with a passing recording medium and a detection part 92 to detect movement of the moving member 90. The moving member 90 has a third support shaft 94 rotatably supported with the fixing device main body 66, a recording medium contact part 96 diagonally extending from the third support shaft 94 toward first recording medium guide member 78 and a detected part 98 extending to the opposite side to the first recording medium guide member 78. The recording medium contact part 96 is provided oppositely to the first recording medium guide member 78, and an end of the recording medium contact part 96 enters the first recording medium guide member 78 side. When a recording medium is passed, the recording medium becomes into contact with the recording medium contact part 96, and the moving member 90 is rotated from a position indicated with a solid line to a position indicated with an alternate long and two short dashes line.

The detection part 92 which is an e.g. optical unit is provided with a light emitting device and a photoreception device, holding the detected part 98 therebetween. As indicated with a solid line in FIG. 2, when a recording medium is not passed, the detected part 98 is positioned on a straight line connecting the light emitting device and the photoreception device. In this case, light emitted from the light emitting device is not received by the photoreception device, and the status where a recording medium is not passed is detected. On the other hand, as indicated with an alternate long and two short dashes line in FIG. 2, when a recording medium is passed, the detected part 98 is positioned out of the straight line connecting the light emitting device and the photoreception device, and light emitted from the light emitting device is received by the photoreception device. Accordingly, the status where a recording medium is passed is detected. Thereafter, when the rear end of the recording medium has been passed, the moving member 90 is returned to the position indicated with the solid line, again light emitted from the light emitting device is not received by the photoreception device, and it is detected that the recording medium has been passed.

Further, when the rear end of the recording medium is passed through the second recording medium guide member 80, the discharge roller 42 is reverse-rotated in the case of double-sided printing, and the recording medium is turned around and guided to the reverse passage 44. Further, when the recording medium has not been passed through the detection device 88 within a predetermined period, it is determined that a jam has occurred, then the occurrence of the jam is displayed, and a countermeasure such as stoppage of heating of the heating roller 70 is performed.

As described above, when the cover 62 is opened, the engagement between the cover 62 and the first recording medium guide member 78 is released, and the cover 62 becomes rotatable about the first support shaft 84 in the counterclockwise direction. As shown in FIG. 3, when the first recording medium guide member 78 is rotated about the first support shaft 84 in the counterclockwise direction, the second recording medium guide member 80 is also rotated, together with the first recording medium guide member 78, about the first support shaft 84 in the counterclockwise direction, and further, rotated about the second support shaft 86 in the counterclockwise direction. Accordingly, a portion above the press contact part 72 is widely opened, and the jammed recording medium can be easily removed.

Next, a second exemplary embodiment of the present invention will be described using FIG. 4 and FIG. 5.

Figure 4:
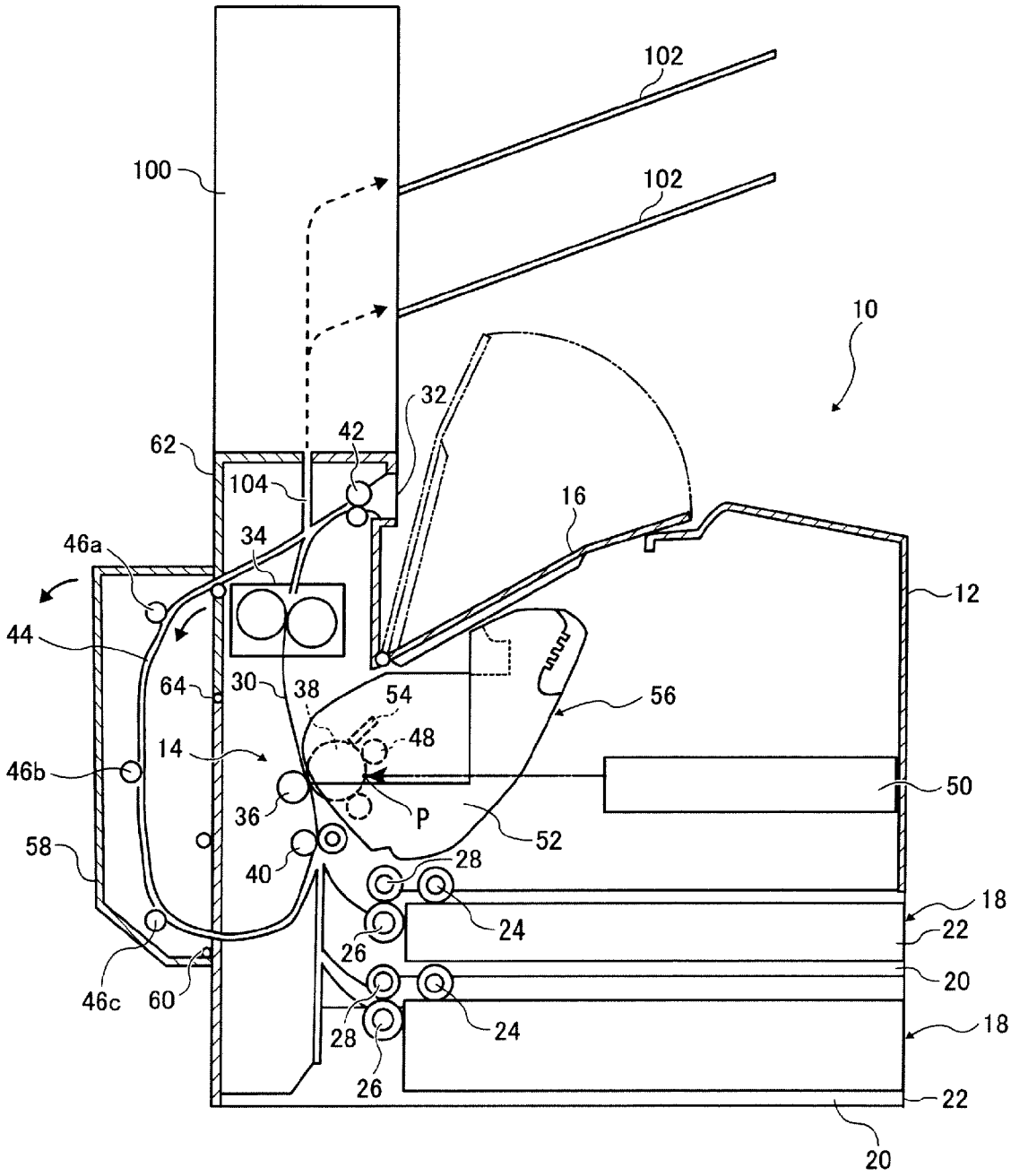
FIG. 4 is a cross-sectional view showing the image forming apparatus according to a second exemplary embodiment of the present invention.

FIG. 4 is a cross-sectional view showing the image forming apparatus 10 according to the second exemplary embodiment. FIG. 5 is a cross-sectional view showing the fixing device 34 used in the second exemplary embodiment and the peripheral elements of the fixing device 34.

In comparison with the first exemplary embodiment, the difference is that in the second exemplary embodiment, an optional unit 100 is provided on the recording medium discharge portion of the image processing apparatus main body 12. The optional unit 100 which is e.g. a sorter sorts recording media passed through the fixing device 34 to plural discharge trays 102.

In this manner, in the image forming apparatus 10 to which the optional unit 100 is attached, an optional conveyance passage (second branch passage) 104 to guide a recording medium to the optional unit 100 is branched from the conveyance passage 30 above the second recording medium guide member 80. The optional conveyance passage 104 is provided with a conveyance roller 106. A switching member 108 is provided in the branching point between the conveyance passage 30 and the optional conveyance passage 104. The switching member 108 is rotatably supported via a fourth support shaft 110 with the image forming apparatus main body 12. The switching member 108 is moved by a driving part such as a solenoid (not shown) between a position indicated with a solid line and a position indicated with an alternate long and two short dashes line via the fourth support shaft 110, and held in the respective positions. When the switching member 108 is in the position indicated with the solid line, a recording medium is discharged via the conveyance passage 30 or guided to the reverse passage 44 by reverse rotation of the discharge roller 42. When the switching member 108 is in the position indicated with the alternate long and two short dashes line, the recording medium is guided to the optional conveyance passage 104. In this case, as the second recording medium guide member 80 is rotated in the counterclockwise direction to the position indicated with the alternate long and two short dashes line by the elasticity of the recording medium, the recording medium can be infallibly guided with the second recording medium guide member 80 to the optional conveyance passage 104.

Next, a third exemplary embodiment of the present invention will be described using FIG. 5 to FIG. 8. In the above-described second exemplary embodiment, the second recording medium guide member 80 closes the conveyance passage 30 by its own weight. When a recording medium is conveyed, the second recording medium guide member 80 is pressed with the recording medium and rotated about the second support shaft 86 in the counterclockwise direction, and opens the conveyance passage 30. To guide the recording medium to the discharge outlet 32, the recording medium is guided via the switching member 108 to the discharge outlet 32 in a direction determined with the second recording medium guide member 80. Accordingly, the probability of occurrence of paper jam is low. On the other hand, when the recording medium is guided to the optional conveyance passage 104, the recording medium is guided via the switching member 108 in an approximately vertical direction with the weight of the second recording medium guide member 80 as a load. In this arrangement, when a low-elasticity recording medium is used, there may occur paper jam. Further, detection of the recording medium by the detection device 88 may be unstable.

Figure 5:
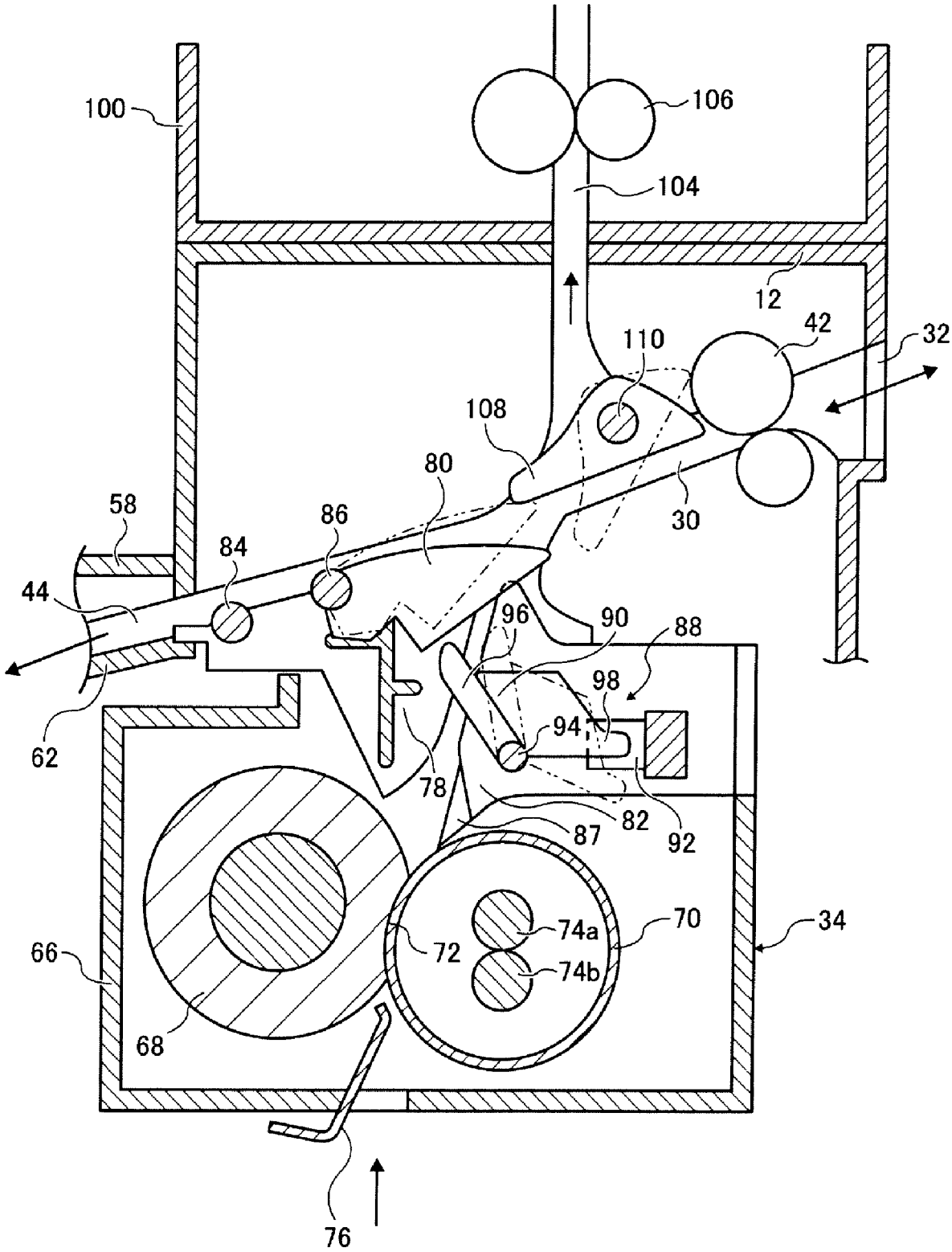
FIG. 5 is a cross-sectional view showing the double-sided recording unit, and the fixing device 34 with its cover closed and the peripheral elements of the fixing device 34 in the second exemplary embodiment of the present invention.
Figure 6:
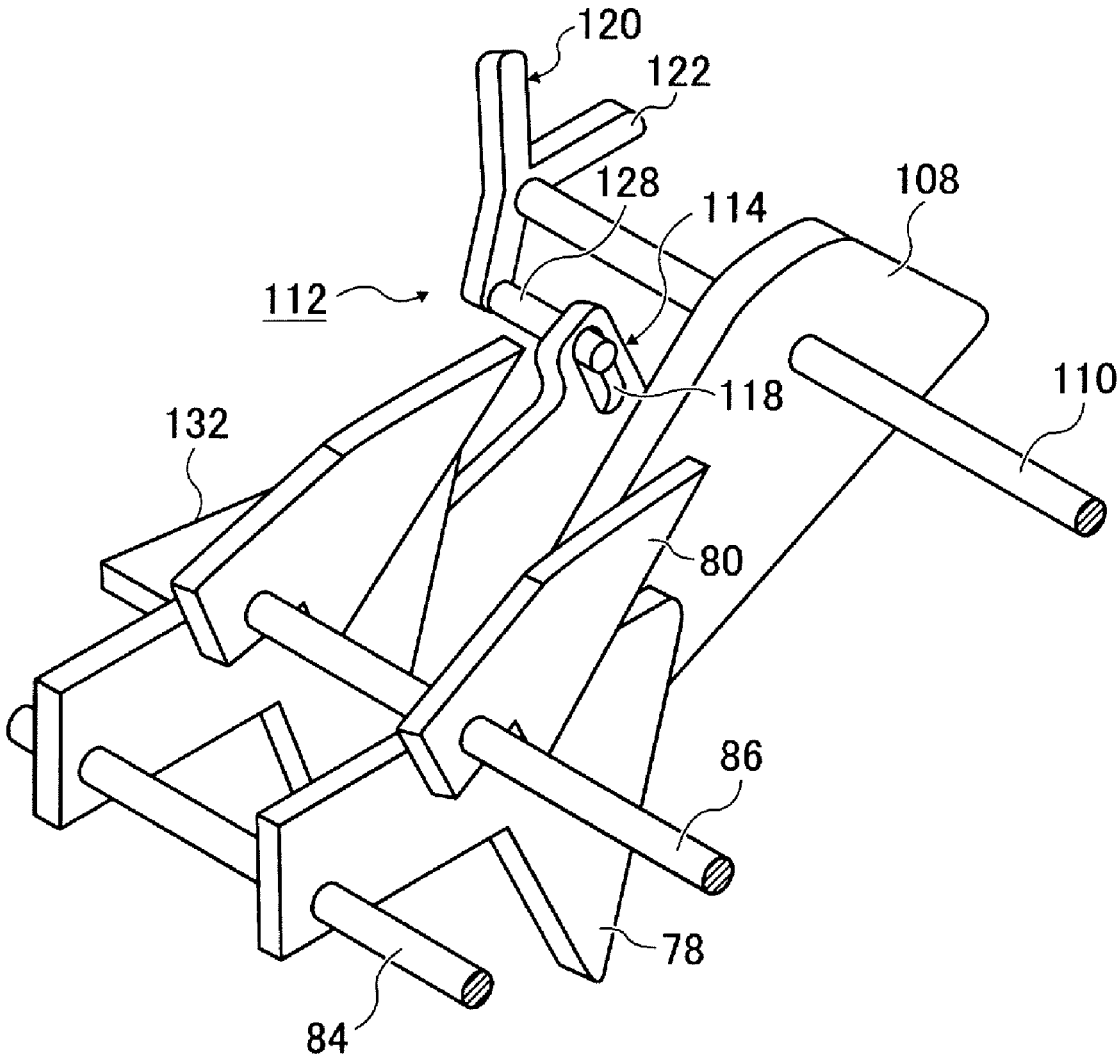
FIG. 6 is a perspective view of principal members according to a third exemplary embodiment of the present invention.

In the third exemplary embodiment, when a recording medium is guided to the optional conveyance passage 104, a holding part 112 to hold the second recording medium guide member 80 in a position indicated with an alternate long and two short dashes line in FIG. 5 is provided so as to reduce the load on the recording medium. The holding part 112 has a coupling member 114 coupling the second recording medium guide member 80 with the switching member 108. The coupling member 114 is rotatably supported via a fifth support shaft 116 with the image forming apparatus main body 12. The coupling member 114 has an oblong hole transmission groove 118. On the other hand, at an end of the switching member 108, a drive transmission part 120 is provided on the fourth support shaft 110. The drive transmission part 120 has an input side transmission part 122 projected in a radial direction of the fourth support shaft 110 and an output side transmission part 124. The input side transmission part 122 is coupled with a driving part 126 such as a solenoid provided on the optional unit 100 side. The input side transmission part 122 receives a driving force from the driving part 126 and rotate-drives the switching member 108. The output side transmission part 124 is provided with a coupling shaft 128 projected in parallel with the fifth support shaft 116. The coupling shaft 128 is engaged slidably with the transmission groove 118 of the coupling member 114. When the switching member 108 is rotated about the fourth support shaft 110 by the driving part 126, the rotating force of the switching member 108 is transmitted via the drive transmission part 120 to the coupling member 114, and the coupling member 114 is rotated about the fifth support shaft 116.

Further, the coupling member 114 is provided with a pressing part 130 formed toward the second recording medium guide member 80 side. On the other hand, a pressed part 132 is formed at an end of the second recording medium guide member 80 oppositely to the pressing part 130 of the coupling member 114.

Note that the pressed part 132 of the second recording medium guide member 80 is formed so as not to interfere with the first recording medium guide member 78.

Figure 7:
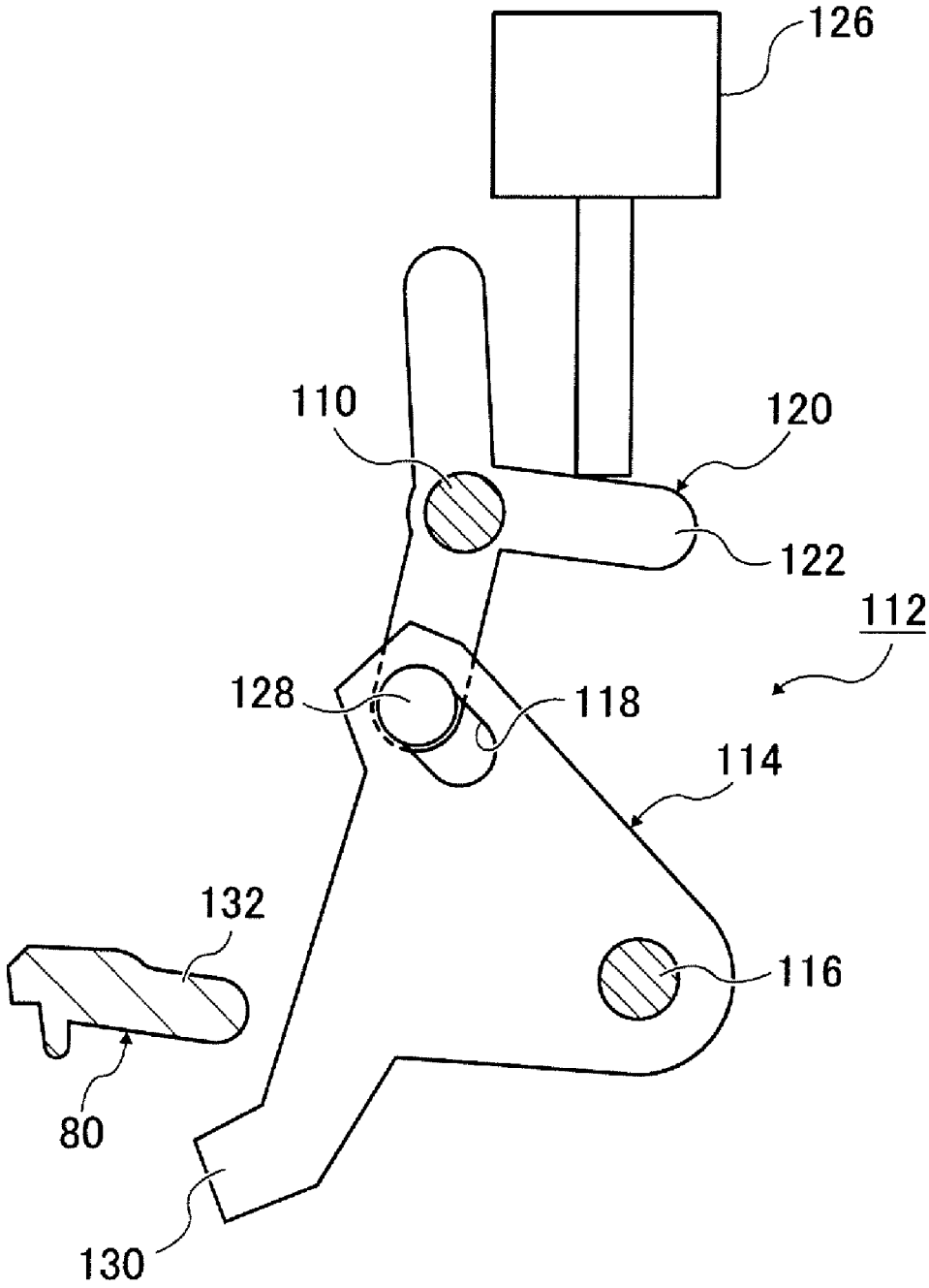
FIG. 7 is a cross-sectional view showing a status where a switching member closes an optional conveyance passage in the third exemplary embodiment of the present invention.

In this arrangement, as shown in FIG. 7, in a status where the driving part 126 presses the input side transmission part 122 of the drive transmission part 120 in the switching member 108 in the clockwise direction, the switching member 108 is in the position indicated with the solid line in FIG. 5, and the pressing part 130 of the coupling member 114 is away from the pressed part 132 of the second recording medium guide member 80. Accordingly, in this status, as in the case of the second exemplary embodiment, the second recording medium guide member 80 closes the conveyance passage 30 by its own weight. When a recording medium is conveyed, the second recording medium guide member 80 is pressed with the recording medium and rotated about the second support shaft 86 in the counterclockwise direction. Then the second recording medium guide member 80 opens the conveyance passage 30, and the recording medium is guided via the switching member 108 to the discharge outlet 32.

Figure 8:
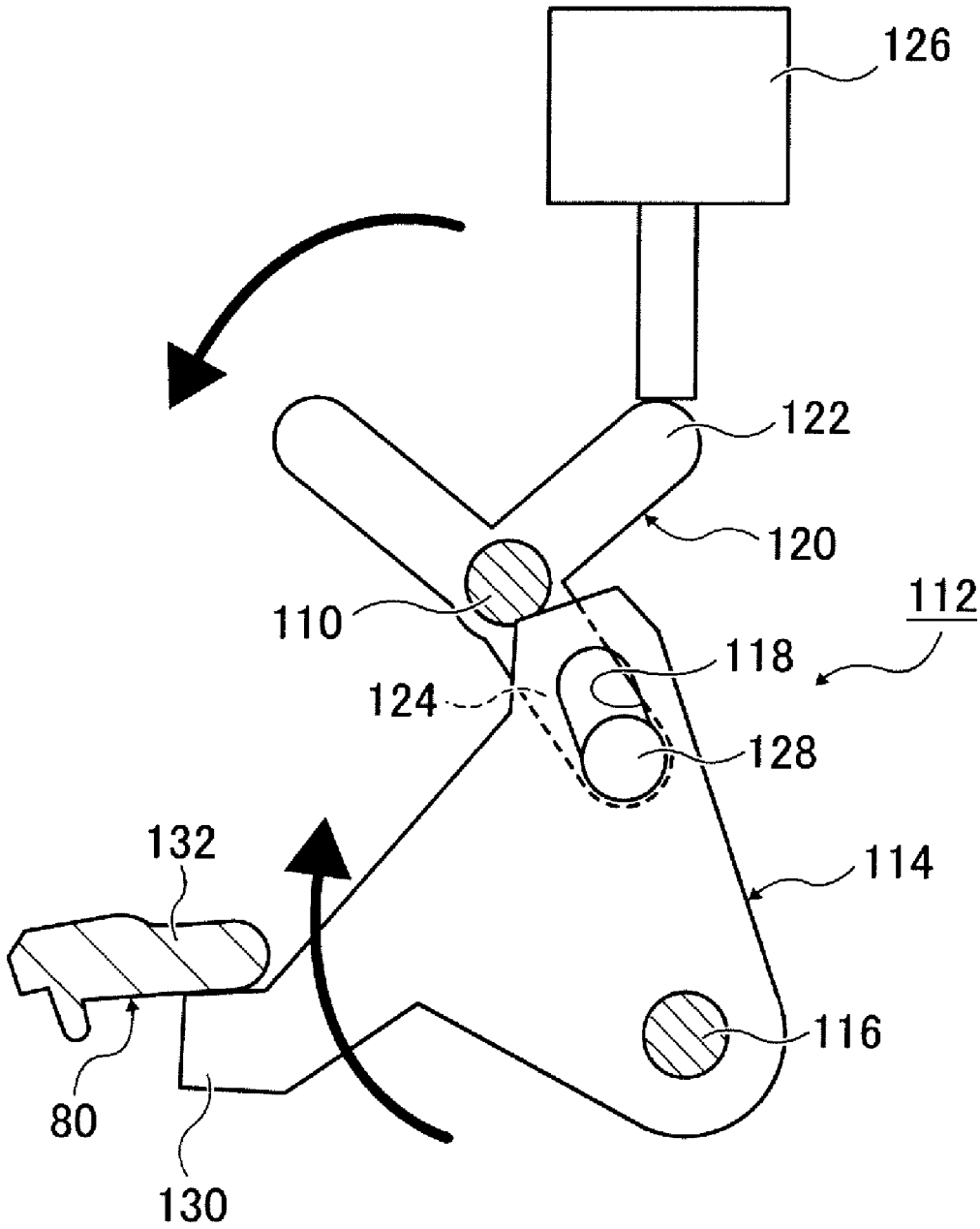
FIG. 8 is a cross-sectional view showing a status where the switching member opens the optional conveyance passage in the third exemplary embodiment of the present invention.

Note that when the driving part 126 is pulled in as shown in FIG. 8, the switching member 108 is rotated about the fourth support shaft 110 in the counterclockwise direction, and moved to the position indicated with the alternate long and two short dashes line in FIG. 5. When the switching member 108 is further rotated in the counterclockwise direction, the rotating force of the switching member 108 is transmitted via the output side transmission part 124, the coupling shaft 128 and the transmission groove 118 to the coupling member 114. The coupling member 114 is rotated about the fifth support shaft 116 in the clockwise direction. When the coupling member 114 is rotated in the clockwise direction, the pressing part 130 of the coupling member 114 abuts against the pressed part 132 of the second recording medium guide member 80, and further, pulls the pressed part 132 upward. When the pressed part 132 is pulled upward, the second recording medium guide member 80 is rotated about the second support shaft 86 in the counterclockwise direction, and held in the position indicated with the alternate long and two short dashes line in FIG. 5. Accordingly, as the second recording medium guide member 80 is held while the conveyance passage 30 is opened, the recording medium is smoothly guided from the conveyance passage 30 to the optional conveyance passage 104.

Note that in the above-described three exemplary embodiments, the fixing device 34 has the pressure roller 68 and the heating roller 70. However, the present invention is not limited to this arrangement. For example, it may be arranged such that the fixing device 34 has two heating rollers or has a belt in place of the heating roller.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming apparatus main body;

a cover provided openably/closably with respect to the image forming apparatus main body;

a conveyance passage, formed in the image forming apparatus main body, on which a recording medium is conveyed;

a detection device that detects movement of the recording medium conveyed on the conveyance passage;

a first guide member provided oppositely to the detection device, the first guide member being movable separate from the cover when the cover is opened and fixed when the cover is closed;

a second guide member that movably guides the conveyed recording medium; and a holding unit that holds the second guide member in a status where the conveyance passage is opened, wherein a portion of the first guide member is provided further upstream in a recording medium conveyance direction than the second guide member, a first branch passage branched from the conveyance passage and is employed to convey the recording medium passed through the conveyance passage and again pass the recording medium through the conveyance passage;

a second branch passage branched from the conveyance passage; and a switching member being movable between a first position where the switching member closes the second branch passage and opens the conveyance passage, and a second position where the switching member closes the conveyance passage and opens the second branch passage, wherein the second guide member closes the conveyance passage by its own weight, and opens the conveyance passage by being pressed with the recording medium by conveyance of the recording medium when the switching member is moved to the first position, and is moved to a position so as not to obstruct the conveyance passage and closes the first branch passage when the switching member is moved to the second position.

2. The image forming apparatus according to claim 1, wherein the second guide member guides the recording medium conveyed on the first branch passage.

3. The image forming apparatus according to claim 1, wherein the second guide member is provided rotatably with respect to the first guide member.

4. The image forming apparatus according to claim 1, wherein the conveyance passage is provided with a forward/reverse rotatable discharge roller, and wherein the recording medium is passed through the second guide member by forward rotation of the discharge roller, while the recording medium is conveyed to the first branch passage by reverse rotation of the discharge roller.

5. The image forming apparatus according to claim 4, wherein the discharge roller is reverse-rotated when the detection device has detected that a rear end of the recording medium has been passed through the second guide member.

6. The image forming apparatus according to claim 1, further comprising a fixing member that fixes an image to the recording medium, wherein the first guide member is provided on a downstream side of the fixing member in the recording medium conveyance direction, and guides the recording medium passed through the fixing member.

7. The image forming apparatus according to claim 1, wherein the detection device has a moving member moved with the recording medium conveyed on the conveyance passage and a detection part that detects movement of the moving member.

8. The image forming apparatus according to claim 1, further comprising:

a fixing member that fixes an image to the recording medium; and the switching member that selects the conveyance passage or the second branch passage, as a passage to which the recording medium passed through the fixing member is conveyed.

9. The image forming apparatus according to claim 1, wherein the holding unit has a coupling member that couples the switching member with the second guide member to interlock the second guide member with the switching member.

10. The image forming apparatus according to claim 1, wherein the second guide member is movably supported by the first guide member and separated from the cover.

* * * * *